US008209997B2

(12) United States Patent
Malsam

(10) Patent No.: US 8,209,997 B2
(45) Date of Patent: Jul. 3, 2012

(54) ISO-PRESSURE OPEN REFRIGERATION NGL RECOVERY

(75) Inventor: Michael Malsam, Sugar Land, TX (US)

(73) Assignee: Lummus Technology, Inc., Bloomfield, NJ (US)

( * ) Notice: Subject to any disclaimer, the term of this patent is extended or adjusted under 35 U.S.C. 154(b) by 1039 days.

(21) Appl. No.: 12/121,880

(22) Filed: May 16, 2008

(65) Prior Publication Data

US 2009/0282864 A1 Nov. 19, 2009

(51) Int. Cl.
*F25J 3/00* (2006.01)

(52) U.S. Cl. ..... 62/630; 62/620; 62/623

(58) Field of Classification Search ..... 62/620, 62/621, 611, 618, 630
See application file for complete search history.

(56) References Cited

U.S. PATENT DOCUMENTS

| | | | | | |
|---|---|---|---|---|---|
| 3,568,458 | A * | 3/1971 | Hoffman | 62/630 |
| 4,854,955 | A * | 8/1989 | Campbell et al. | 62/621 |
| 5,685,170 | A * | 11/1997 | Sorensen | 62/625 |
| 5,799,507 | A * | 9/1998 | Wilkinson et al. | 62/621 |
| 6,116,050 | A | 9/2000 | Yao et al. | |
| 6,425,266 | B1 | 7/2002 | Roberts | |
| 6,837,070 | B2 | 1/2005 | Mak | |
| 7,051,553 | B2 | 5/2006 | Mak et al. | |
| 7,219,513 | B1 * | 5/2007 | Mostafa | 62/620 |
| 7,237,407 | B2 | 7/2007 | Paradowski | |
| 2004/0244415 | A1 * | 12/2004 | Paradowski | 62/612 |
| 2005/0086976 | A1 * | 4/2005 | Eaton | 62/612 |
| 2006/0260355 | A1 * | 11/2006 | Roberts et al. | 62/620 |
| 2007/0240450 | A1 * | 10/2007 | Mak | 62/626 |
| 2008/0000216 | A1 | 1/2008 | Fujimura et al. | |
| 2008/0000265 | A1 * | 1/2008 | Cuellar et al. | 62/630 |

OTHER PUBLICATIONS

International Search Report dated Jun. 18, 2009.
International Preliminary Report on Patentability for International Application No. PCT/US09/42260 dated Nov. 8, 2010.

* cited by examiner

*Primary Examiner* — Frantz Jules
*Assistant Examiner* — Keith Raymond
(74) *Attorney, Agent, or Firm* — Alix, Yale & Ristas, LLP

(57) ABSTRACT

The present invention relates to an improved process for recovery of natural gas liquids from a natural gas feed stream. The process runs at a constant pressure with no intentional reduction in pressure. An open loop mixed refrigerant is used to provide process cooling and to provide a reflux stream for the distillation column used to recover the natural gas liquids. The processes may be used to recover $C_3$+ hydrocarbons from natural gas, or to recover $C_2$+ hydrocarbons from natural gas.

14 Claims, 4 Drawing Sheets

ISO-PRESSURE OPEN REFRIGERATION NGL RECOVERY

FIELD OF THE INVENTION

The present invention relates to improved processes for recovery of natural gas liquids from gas feed streams containing hydrocarbons, and in particular to recovery of propane and ethane from gas feed streams.

BACKGROUND

Natural gas contains various hydrocarbons, including methane, ethane and propane. Natural gas usually has a major proportion of methane and ethane, i.e. methane and ethane together typically comprise at least 50 mole percent of the gas. The gas also contains relatively lesser amounts of heavier hydrocarbons such as propane, butanes, pentanes and the like, as well as hydrogen, nitrogen, carbon dioxide and other gases. In addition to natural gas, other gas streams containing hydrocarbons may contain a mixture of lighter and heavier hydrocarbons. For example, gas streams formed in the refining process can contain mixtures of hydrocarbons to be separated. Separation and recovery of these hydrocarbons can provide valuable products that may be used directly or as feedstocks for other processes. These hydrocarbons are typically recovered as natural gas liquids (NGL).

The present invention is primarily directed to recovery of $C_3$+ components in gas streams containing hydrocarbons, and in particular to recovery of propane from these gas streams. A typical natural gas feed to be processed in accordance with the processes described below typically may contain, in approximate mole percent, 92.12% methane, 3.96% ethane and other $C_2$ components, 1.05% propane and other $C_3$ components, 0.15% iso-butane, 0.21% normal butane, 0.11% pentanes or heavier, and the balance made up primarily of nitrogen and carbon dioxide. Refinery gas streams may contain less methane and higher amounts of heavier hydrocarbons.

Recovery of natural gas liquids from a gas feed stream has been performed using various processes, such as cooling and refrigeration of gas, oil absorption, refrigerated oil absorption or through the use of multiple distillation towers. More recently, cryogenic expansion processes utilizing Joule-Thompson valves or turbo expanders have become preferred processes for recovery of NGL from natural gas.

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high pressure liquids containing the desired components.

The high-pressure liquids may be expanded to a lower pressure and fractionated. The expanded stream, comprising a mixture of liquid and vapor, is fractionated in a distillation column. In the distillation column volatile gases and lighter hydrocarbons are removed as overhead vapors and heavier hydrocarbon components exit as liquid product in the bottoms.

The feed gas is typically not totally condensed, and the vapor remaining from the partial condensation may be passed through a Joule-Thompson valve or a turbo expander to a lower pressure at which further liquids are condensed as a result of further cooling of the stream. The expanded stream is supplied as a feed stream to the distillation column.

A reflux stream is provided to the distillation column, typically a portion of partially condensed feed gas after cooling but prior to expansion. Various processes have used other sources for the reflux, such as a recycled stream of residue gas supplied under pressure.

While various improvements to the general cryogenic processes described above have been attempted, these improvements continue to use a turbo expander or Joule-Thompson valve to expand the feed stream to the distillation column. It would be desirable to have an improved process for enhanced recovery of NGLs from a natural gas feed stream.

SUMMARY OF THE INVENTION

The present invention relates to improved processes for recovery of NGLs from a feed gas stream. The process utilizes an open loop mixed refrigerant process to achieve the low temperatures necessary for high levels of NGL recovery. A single distillation column is utilized to separate heavier hydrocarbons from lighter components such as sales gas. The overhead stream from the distillation column is cooled to partially liquefy the overhead stream. The partially liquefied overhead stream is separated into a vapor stream comprising lighter hydrocarbons, such as sales gas, and a liquid component that serves as a mixed refrigerant. The mixed refrigerant provides process cooling and a portion of the mixed refrigerant is used as a reflux stream to enrich the distillation column with key components. With the gas in the distillation column enriched, the overhead stream of the distillation column condenses at warmer temperatures, and the distillation column runs at warmer temperatures than typically used for high recoveries of NGLs. The process achieves high recovery of desired NGL components without expanding the gas as in a Joule-Thompson valve or turbo expander based plant, and with only a single distillation column.

In one embodiment of the process of the present invention, $C_3$+ hydrocarbons, and in particular propane, are recovered. Temperatures and pressures are maintained as required to achieve the desired recovery of $C_3$+ hydrocarbons based upon the composition of the incoming feed stream. In this embodiment of the process, feed gas enters a main heat exchanger and is cooled. The cooled feed gas is fed to a distillation column, which in this embodiment functions as a deethanizer. Cooling for the feed stream may be provided primarily by a warm refrigerant such as propane. The overhead stream from the distillation column enters the main heat exchanger and is cooled to the temperature required to produce the mixed refrigerant and to provide the desired NGL recovery from the system.

The cooled overhead stream from the distillation column is combined with an overhead stream from a reflux drum and separated in a distillation column overhead drum. The overhead vapor from the distillation column overhead drum is sales gas (i.e. methane, ethane and inert gases) and the liquid bottoms are the mixed refrigerant. The mixed refrigerant is enriched in $C_2$ and lighter components as compared to the feed gas. The sales gas is fed through the main heat exchanger where it is warmed. The temperature of the mixed refrigerant is reduced to a temperature cold enough to facilitate the necessary heat transfer in the main heat exchanger. The temperature of the refrigerant is lowered by reducing the refrigerant pressure across a control valve. The mixed refrigerant is fed to the main heat exchanger where it is evaporated and super heated as it passes through the main heat exchanger.

After passing through the main heat exchanger, the mixed refrigerant is compressed. Preferably, the compressor discharge pressure is greater than the distillation column pressure so no reflux pump is necessary. The compressed gas passes through the main heat exchanger, where it is partially condensed. The partially condensed mixed refrigerant is routed to a reflux drum. The bottom liquid from the reflux drum is used as a reflux stream for the distillation column. The vapors from the reflux drum are combined with the distillation column over head stream exiting the main heat exchanger and the combined stream is routed to the distillation column overhead drum. In this embodiment, the process of the invention can achieve over 99 percent recovery of propane from the feed gas.

In another embodiment of the process, the feed gas is treated as described above and a portion of the mixed refrigerant is removed from the plant following compression and cooling. The portion of the mixed refrigerant removed from the plant is fed to a $C_2$ recovery unit to recover the ethane in the mixed refrigerant. Removal of a portion of the mixed refrigerant stream after it has passed through the main heat exchanger and been compressed and cooled has minimal effect on the process provided that enough $C_2$ components remain in the system to provide the required refrigeration. In some embodiments, as much as 95 percent of the mixed refrigerant stream may be removed for $C_2$ recovery. The removed stream may be used as a feed stream in an ethylene cracking unit.

In another embodiment of the process, an absorber column is used to separate the distillation column overhead stream. The overhead stream from the absorber is sales gas, and the bottoms are the mixed refrigerant.

In yet another embodiment of the invention, only one separator drum is used. In this embodiment of the invention, the compressed, cooled mixed refrigerant is returned to the distillation column as a reflux stream.

The process described above may be modified to achieve separation of hydrocarbons in any manner desired. For example, the plant may be operated such that the distillation column separates $C_4$+ hydrocarbons, primarily butane, from $C_3$ and lighter hydrocarbons. In another embodiment of the invention, the plant may be operated to recover both ethane and propane. In this embodiment of the invention, the distillation column is used as a demethanizer, and the plant pressures and temperatures are adjusted accordingly. In this embodiment, the bottoms from the distillation tower contain primarily the $C_2$+ components, while the overhead stream contains primarily methane and inert gases. In this embodiment, recovery of as much as 55 percent of the $C_2$+ components in the feed gas can be obtained.

Among the advantages of the process is that the reflux to the distillation column is enriched, for example in ethane, reducing loss of propane from the distillation column. The reflux also increases the mole fraction of lighter hydrocarbons, such as ethane, in the distillation column making it easier to condense the overhead stream. This process uses the liquid condensed in the distillation column overhead twice, once as a low temperature refrigerant and the second time as a reflux stream for the distillation column. Other advantages of the processes of the present invention will be apparent to those skilled in the art based upon the detailed description of preferred embodiments provided below.

DETAILED DESCRIPTION OF EMBODIMENTS OF THE INVENTION

The present invention relates to improved processes for recovery of natural gas liquids (NGL) from gas feed streams containing hydrocarbons, such as natural gas or gas streams from petroleum processing. The process of the present invention runs at approximately constant pressures with no intentional reduction in gas pressures through the plant. The process uses a single distillation column to separate lighter hydrocarbons and heavier hydrocarbons. An open loop mixed refrigerant provides process cooling to achieve the temperatures required for high recovery of NGL gases. The mixed refrigerant is comprised of a mixture of the lighter and heavier hydrocarbons in the feed gas, and is generally enriched in the lighter hydrocarbons as compared to the feed gas.

The open loop mixed refrigerant is also used to provide an enriched reflux stream to the distillation column, which allows the distillation column to operate at higher temperatures and enhances the recovery of NGLs. The overhead stream from the distillation column is cooled to partially liquefy the overhead stream. The partially liquefied overhead stream is separated into a vapor stream comprising lighter hydrocarbons, such as sales gas, and a liquid component that serves as a mixed refrigerant.

The process of the present invention may be used to obtain the desired separation of hydrocarbons in a mixed feed gas stream. In one embodiment, the process of the present application may be used to obtain high levels of propane recovery. Recovery of as much as 99 percent or more of the propane in the feed case may be recovered in the process. The process can also be operated in a manner to recover significant amounts of ethane with the propane or reject most of the ethane with the sales gas. Alternatively, the process can be operated to recover a high percentage of $C_4$+ components of the feed stream and discharge $C_3$ and lighter components.

Figure 1:
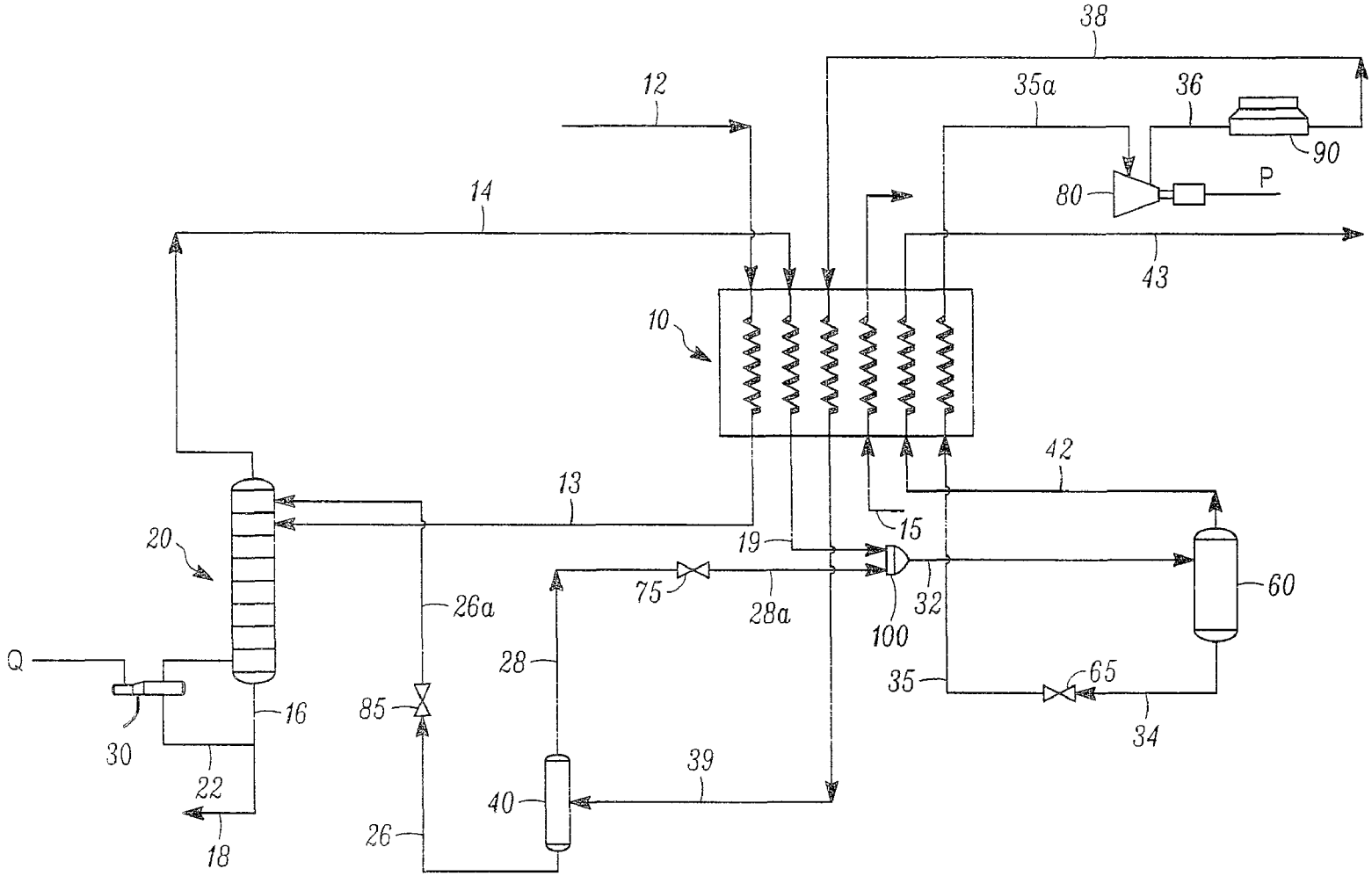
FIG. 1 is a schematic drawing of a plant for performing embodiments of the method of the present invention in which the mixed refrigerant stream is compressed and returned to the reflux separator.

A plant for performing some embodiments of the process of the present invention is shown schematically in FIG. 1. It should be understood that the operating parameters for the plant, such as the temperature, pressure, flow rates and compositions of the various streams, are established to achieve the desired separation and recovery of the NGLs. The required operating parameters also depend on the composition of the feed gas. The required operating parameters can be readily determined by those skilled in the art using known techniques, including for example computer simulations. Accordingly, the descriptions and ranges of the various operating parameters provided below are intended to provide a description of specific embodiments of the invention, and they are not intended to limit the scope of the invention in any way.

Feed gas is fed through line (12) to main heat exchanger (10). The feed gas may be natural gas, refinery gas or other gas stream requiring separation. The feed gas is typically filtered and dehydrated prior to being fed into the plant to prevent freezing in the NGL unit. The feed gas is typically fed to the main heat exchanger at a temperature between about 110° F. and 130° F. and at a pressure between about 100 psia and 450 psia. The feed gas is cooled and partially liquefied in the main heat exchanger (10) by making heat exchange contact with cooler process streams and with a refrigerant which may be fed to the main heat exchanger through line (15) in an amount necessary to provide additional cooling necessary for the process. A warm refrigerant such as propane may be used to provide the necessary cooling for the feed gas. The feed gas is cooled in the main heat exchanger to a temperature between about 0° F. and −40° F.

The cool feed gas (12) exits the main heat exchanger (10) and enters the distillation column (20) through feed line (13). The distillation column operates at a pressure slightly below the pressure of the feed gas, typically at a pressure of between about 5 psi and 10 psi less than the pressure of the feed gas. In the distillation column, heavier hydrocarbons, such as for example propane and other $C_3$+ components, are separated from the lighter hydrocarbons, such as ethane, methane and other gases. The heavier hydrocarbon components exit in the liquid bottoms from the distillation column through line (16), while the lighter components exit through vapor overhead line (14). Preferably, the bottoms stream (16) exits the distillation column at a temperature of between about 150° F. and 300° F., and the overhead stream (14) exits the distillation column at a temperature of between about −10° F. and −80° F.

The bottoms stream (16) from the distillation column is split, with a product stream (18) and a recycle stream (22) directed to a reboiler (30) which receives heat input (Q). Optionally, the product stream (18) may be cooled in a cooler to a temperature between about 60° F. and 130° F. The product stream (18) is highly enriched in the heavier hydrocarbons in the feed gas stream. In the embodiment shown in FIG. 1, the product stream may highly enriched in propane and heavier components, and ethane and lighter gases are removed as sales gas as described below. Alternatively, the plant may be operated such that the product stream is heavily enriched in $C_4$+ hydrocarbons, and the propane is removed with the ethane in the sales gas. The recycle stream (22) is heated in reboiler (30) to provide heat to the distillation column. Any type of reboiler typically used for distillation columns may be used.

The distillation column overhead stream (14) passes through main heat exchanger (10), where it is cooled by heat exchange contact with process gases to partially liquefy the stream. The distillation column overhead stream exits the main heat exchanger through line (19) and is cooled sufficiently to produce the mixed refrigerant as described below. Preferably, the distillation column overhead stream is cooled to between about −30° F. and −130° F. in the main heat exchanger.

In the embodiment of the process shown in FIG. 1, the cooled and partially liquefied stream (19) is combined with the overhead stream (28) from reflux separator (40) in mixer (100) and is then fed through line (32) to the distillation column overhead separator (60). Alternatively, stream (19) may be fed to the distillation column overhead separator (60) without being combined with the overhead stream (28) from reflux separator (40). Overhead stream (28) may be fed to the distillation column overhead separator directly, or in other embodiments of the process, the overhead stream (28) from reflux separator (40) may be combined with the sales gas (42). Optionally, the overhead stream from reflux separator (40) may be fed through control valve (75) prior to being fed through line (28*a*) to be mixed with distillation column overhead stream (19). Depending upon the feed gas used and other process parameters, control valve (75) may be used to hold pressure on the ethane compressor (80), which can ease condensing this stream and to provide pressure to transfer liquid to the top of the distillation column. Alternatively, a reflux pump can be used to provide the necessary pressure to transfer the liquid to the top of the column.

In the embodiment shown in FIG. 1, the combined distillation column overhead stream and reflux drum overhead stream (32) is separated in the distillation column overhead separator (60) into an overhead stream (42) and a bottoms stream (34). The overhead stream (42) from the distillation column overhead separator (60) contains product sales gas (e.g. methane, ethane and lighter components). The bottoms stream (34) from the distillation column overhead separator is the liquid mixed refrigerant used for cooling in the main heat exchanger (10).

The sales gas flows through the main heat exchanger (10) through line (42) and is warmed. In a typical plant, the sales gas exits the deethanizer overhead separator at a temperature of between about −40° F. and −120° F. and a pressure of between about 85 psia and 435 psia, and exits the main heat exchanger at a temperature of between about 100° F. and 120° F. The sales gas is sent for further processing through line (43).

The mixed refrigerant flows through the distillation column overhead separator bottoms line (34). The temperature of the mixed refrigerant may be lowered by reducing the pressure of the refrigerant across control valve (65). The temperature of the mixed refrigerant is reduced to a temperature cold enough to provide the necessary cooling in the main heat exchanger (10). The mixed refrigerant is fed to the main heat exchanger through line (35). The temperature of the mixed refrigerant entering the main heat exchanger is typically between about −60° F. to −175° F. Where the control valve (65) is used to reduce the temperature of the mixed refrigerant, the temperature is typically reduced by between about 20° F. to 50° F. and the pressure is reduced by between about 90 psi to 250 psi. The mixed refrigerant is evaporated and superheated as it passes through the main heat exchanger (10) and exits through line (35*a*). The temperature of the mixed refrigerant exiting the main heat exchanger is between about 80° F. and 100° F.

After exiting the main heat exchanger, the mixed refrigerant is fed to ethane compressor (80). The mixed refrigerant is compressed to a pressure about 15 psi to 25 psi greater than the operating pressure of the distillation column at a temperature of between about 230° F. to 350° F. By compressing the mixed refrigerant to a pressure greater than the distillation column pressure, there is no need for a reflux pump. The compressed mixed refrigerant flows through line (36) to cooler (90) where it is cooled to a temperature of between about 70° F. and 130° F. Optionally, cooler (90) may be omitted and the compressed mixed refrigerant may flow directly to main heat exchanger (10) as described below. The compressed mixed refrigerant then flows through line (38) through the main heat exchanger (10) where it is further cooled and partially liquefied. The mixed refrigerant is cooled in the main heat exchanger to a temperature of between about 15° F. to −70° F. The partially liquefied mixed refrigerant is introduced through line (39) to the reflux separator (40). As described previously, in the embodiment of FIG. 1, the overhead (28) from reflux separator (40) is combined with the overheads (14) from the distillation column and the combined stream (32) is fed to the distillation column overhead separator. The liquid bottoms (26) from the reflux separator (40) are fed back to the distillation column as a reflux stream (26). Control valves (75, 85) may be used to hold pressure on the compressor to promote condensation.

The open loop mixed refrigerant used as reflux enriches the distillation column with gas phase components. With the gas in the distillation column enriched, the overhead stream of the column condenses at warmer temperatures, and the distillation column runs at warmer temperatures than normally required for high recovery of NGLs.

The reflux to the distillation column also reduces losses of heavier hydrocarbons from the column. For example, in processes for recovery of propane, the reflux increases the mole fraction of ethane in the distillation column, which makes it easier to condense the overhead stream. The process uses the liquid condensed in the distillation column overhead drum twice, once as a low temperature refrigerant and the second time as a reflux stream for the distillation column.

Figure 2:
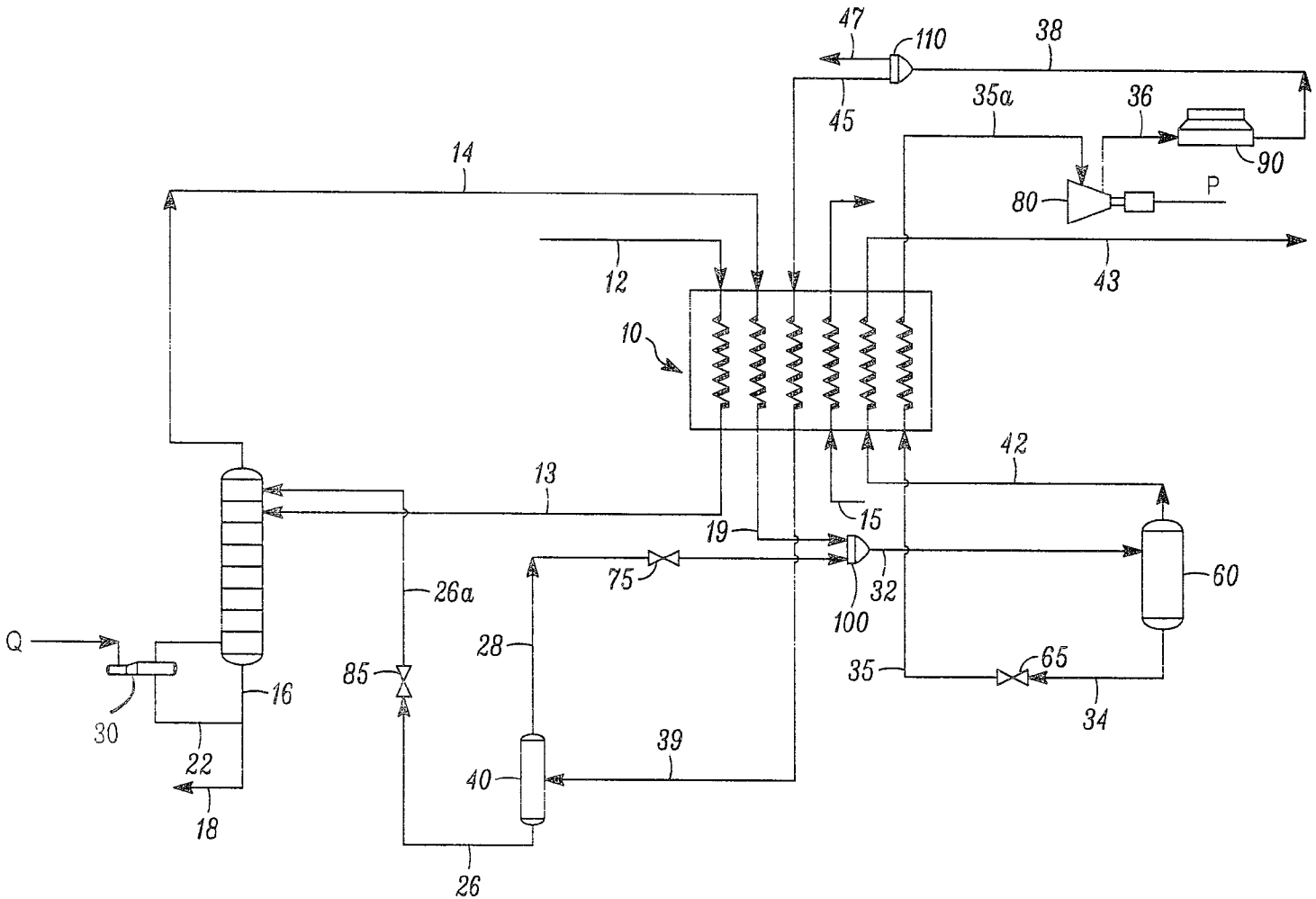
FIG. 2 is a schematic drawing of a plant for performing embodiments of the method of the present invention in which a portion of the compressed mixed refrigerant stream is removed from the plant for ethane recovery.

In another embodiment of the invention shown in FIG. 2, in which like numbers indicate like components and flow streams described above, the process is used to separate propane and other $C_3$+ hydrocarbons from ethane and light components. A tee (110) is provided in line (38) after the mixed refrigerant compressor (80) and the mixed refrigerant cooler to split the mixed refrigerant into a return line (45) and an ethane recovery line (47). The return line (45) returns a portion of the mixed refrigerant to the process through main heat exchanger (10) as described above. Ethane recovery line (47) supplies a portion of the mixed refrigerant to a separate ethane recovery unit for ethane recovery. Removal of a portion of the mixed refrigerant stream has minimal effect on the process provided that enough $C_2$ components remain in the system to provide the required refrigeration. In some embodiments, as much as 95 percent of the mixed refrigerant stream may be removed for $C_2$ recovery. The removed stream may be used, for example, as a feed stream in an ethylene cracking unit.

In another embodiment of the invention, the NGL recovery unit can recover significant amounts of ethane with the propane. In this embodiment of the process, the distillation column is a demethanizer, and the overhead stream contains primarily methane and inert gases, while the column bottoms contain ethane, propane and heavier components.

Figure 3:
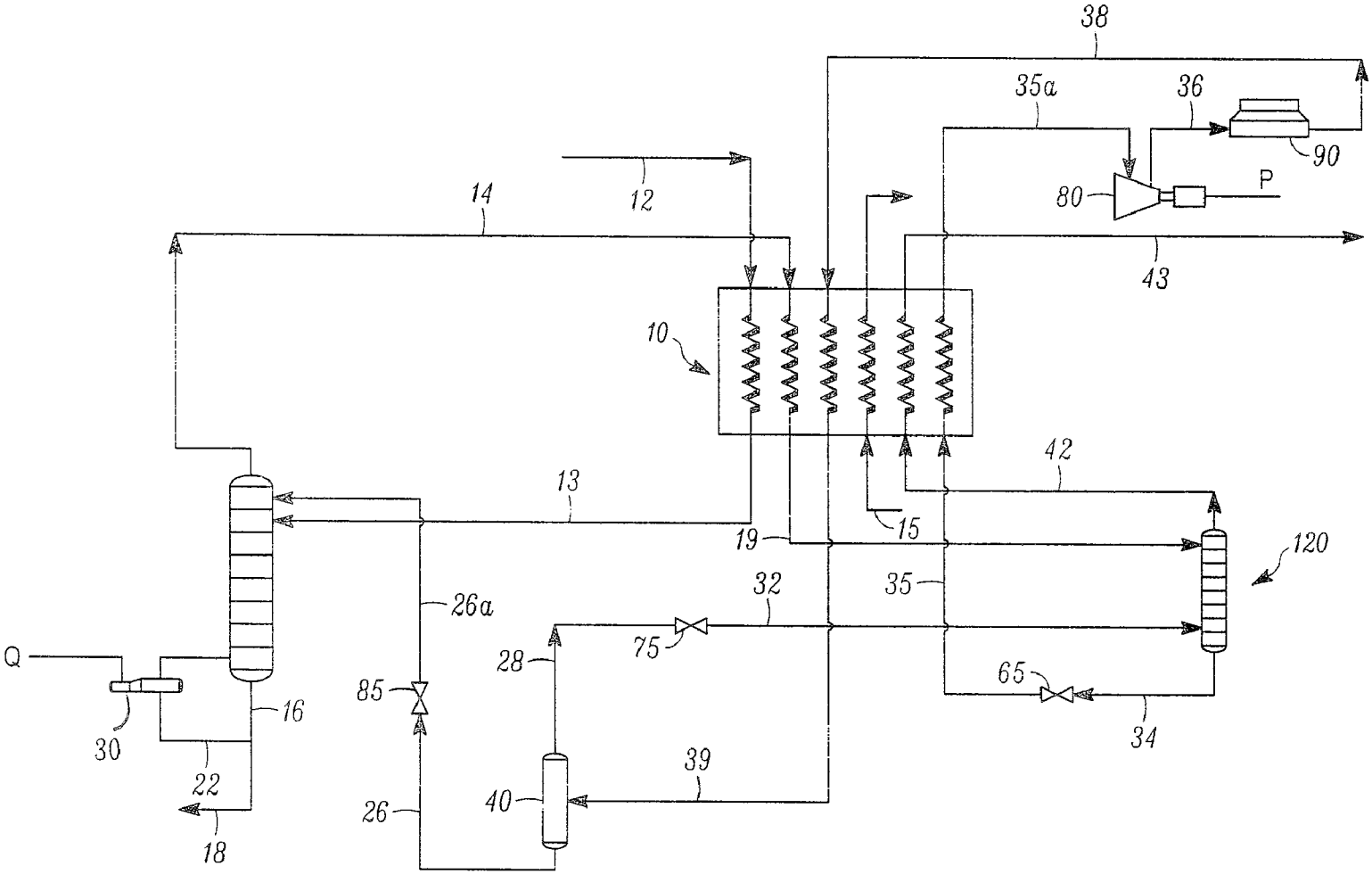
FIG. 3 is a schematic drawing of a plant for performing embodiments of the present invention in which an absorber is used to separate the distillation overhead stream.

In another embodiment of the process, the deethanizer overhead drum may be replaced by an absorber. As shown in FIG. 3, in which like numbers indicate like components and flow streams described above, in this embodiment, the overhead stream (14) from the distillation column (20) passes through main heat exchanger (10) and the cooled stream (19) is fed to absorber (120). The overhead stream (28) from reflux separator (40) is also fed to the absorber (120). The overhead stream (42) from the absorber is the sales gas and the bottoms stream (34) from the absorber is the mixed refrigerant. The other streams and components shown in FIG. 3 have the same flow paths as described above.

Figure 4:
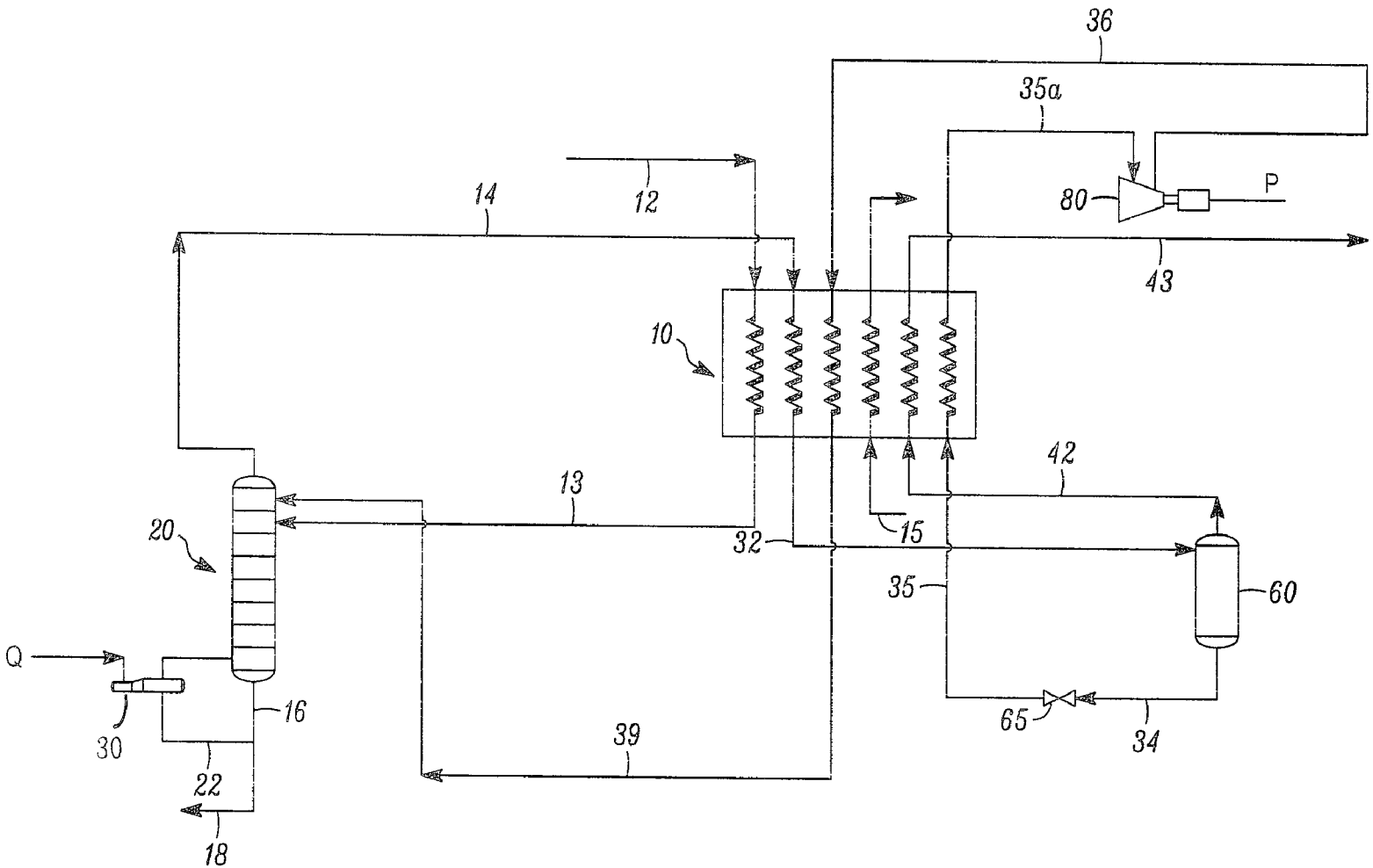
FIG. 4 is a schematic drawing of a plant for performing embodiments of the present invention in which only one separator drum is used.

In yet another embodiment of the invention shown in FIG. 4, in which like numbers indicate like components and flow streams described above, the second separator and the cooler are not used in the process. In this embodiment, the compressed mixed refrigerant (36) is fed through the main heat exchanger (10) and fed to the distillation tower through line (39) to provide reflux flow.

Examples of specific embodiments of the process of the process of the present invention are described below. These examples are provided to further describe the processes of the present invention and they are not intended to limit the full scope of the invention in any way.

Example 1

In the following examples, operation of the processing plant shown in FIG. 1 with different types and compositions of feed gas were computer simulated using process the Apsen HYSYS simulator. In this example, the operating parameters for $C_3$+ recovery using a relatively lean feed gas are provided. Table 1 shows the operating parameters for propane recovery using a lean feed gas. The composition of the feed gas, the sales gas stream and the $C_3$+ product stream, and the mixed refrigerant stream in mole fractions are provided in Table 2. Energy inputs for this embodiment included about $3.717\times10^5$ Btu/hr (Q) to the reboiler (30) and about 459 horsepower (P) to the ethane compressor (80).

TABLE 2

| Mole Fractions of Components in Streams | | | | |
|---|---|---|---|---|
| | Feed Gas (12) | Product (18) | Sales Gas (43) | Mixed Refrigerant (35) |
| Methane | 0.9212 | 0.0000 | 0.9453 | 0.6671 |
| Ethane | 0.0396 | 0.0082 | 0.0402 | 0.3121 |
| Propane | 0.0105 | 0.4116 | 0.0001 | 0.0046 |
| Butane | 0.0036 | 0.1430 | 0.0000 | 0.0000 |
| Pentane | 0.0090 | 0.3576 | 0.0000 | 0.0000 |
| Heptane | 0.0020 | 0.0795 | 0.0000 | 0.0000 |
| $CO_2$ | 0.0050 | 0.0000 | 0.0051 | 0.0145 |
| Nitrogen | 0.0091 | 0.0000 | 0.0094 | 0.0017 |

As can be seen in Table 2, the product stream (18) from the bottom of the distillation column is highly enriched in $C_3$+ components, while the sales gas stream (43) contains almost entirely $C_2$ and lighter hydrocarbons and gases. Approximately 99.6% of the propane in the feed gas is recovered in the product stream. The mixed refrigerant is comprised primarily of methane and ethane, but contains more propane than the sales gas.

Example 2

In this example, operating parameters are provided for the processing plant shown in FIG. 1 using a refinery feed gas for recovery of $C_3$+ components in the product stream. Table 3 shows the operating parameters using the refinery feed gas. The composition of the feed gas, the sales gas stream and the $C_3$+ product stream, and the mixed refrigerant stream in mole fractions are provided in Table 4. Energy inputs for this embodiment included about $2.205\times10^6$ Btu/hr (Q) to the reboiler (30) and about 228 horsepower (P) to the ethane compressor (80).

TABLE 4

| Mole Fractions of Components in Streams | | | | |
|---|---|---|---|---|
| | Feed Gas (12) | Product (18) | Sales Gas (43) | Mixed Refrigerant (35) |
| Hydrogen | 0.3401 | 0.0000 | 0.4465 | 0.0038 |
| Methane | 0.2334 | 0.0000 | 0.3062 | 0.0658 |
| Ethane | 0.1887 | 0.0100 | 0.2439 | 0.8415 |
| Propane | 0.0924 | 0.3783 | 0.0034 | 0.0889 |
| Butane | 0.0769 | 0.3234 | 0.0000 | 0.0000 |
| Pentane | 0.0419 | 0.1760 | 0.0000 | 0.0000 |
| Heptane | 0.0267 | 0.1124 | 0.0000 | 0.0000 |
| $CO_2$ | 0.0000 | 0.0000 | 0.0000 | 0.0000 |
| Nitrogen | 0.0000 | 0.0000 | 0.0000 | 0.0000 |

As can be seen in Table 4, the product stream (18) from the bottom of the distillation column is highly enriched in $C_3$+ components, while the sales gas stream (43) contains almost entirely $C_2$ and lighter hydrocarbons and gases, in particular hydrogen. This stream could be used to feed a membrane unit or PSA to upgrade this stream to useful hydrogen. Approximately 97.2% of the propane in the feed gas is recovered in the product stream. The mixed refrigerant is comprised primarily of methane and ethane, but contains more propane than the sales gas.

Example 3

In this example, operating parameters are provided for the processing plant shown in FIG. 1 using a refinery feed gas for the recovery of $C_4$+ components in the product stream, with the $C_3$ components removed in the sales gas stream. Table 5 shows the operating parameters for this embodiment of the process. The composition of the feed gas, the sales gas stream and the $C_4$+ product stream, and the mixed refrigerant stream in mole fractions are provided in Table 6. Energy inputs for this embodiment included about $2.512\times10^6$ Btu/hr (Q) to the reboiler (30) and about 198 horsepower (P) to the ethane compressor (80).

TABLE 6

Mole Fractions of Components in Streams

| | Feed Gas (12) | Product (18) | Sales Gas (43) | Mixed Refrigerant (35) |
|---|---|---|---|---|
| Hydrogen | 0.3401 | 0.0000 | 0.3975 | 0.0022 |
| Methane | 0.2334 | 0.0000 | 0.2728 | 0.0257 |
| Ethane | 0.1887 | 0.0000 | 0.2220 | 0.2461 |
| Propane | 0.0924 | 0.0100 | 0.1074 | 0.7188 |
| Butane | 0.0769 | 0.5212 | 0.0003 | 0.0071 |
| Pentane | 0.0419 | 0.2861 | 0.0000 | 0.0000 |
| Heptane | 0.0267 | 0.1828 | 0.0000 | 0.0000 |
| $CO_2$ | 0.0000 | 0.0000 | 0.0000 | 0.0000 |
| Nitrogen | 0.0000 | 0.0000 | 0.0000 | 0.0000 |

As can be seen in Table 6, in this embodiment, the product stream (18) from the bottom of the distillation column is highly enriched in $C_4$+ components, while the sales gas stream (43) contains almost entirely $C_3$ and lighter hydrocarbons and gases. Approximately 99.7% of the $C_4$+ components in the feed gas is recovered in the product stream. The mixed refrigerant is comprised primarily of $C_3$ and lighter components, but contains more butane than the sales gas.

Example 4

In this example, operating parameters are provided for the processing plant shown in FIG. 2 using a refinery feed gas for recovery of $C_3$+ components in the product stream, with the $C_2$ and lighter components removed in the sales gas stream. In this embodiment, a portion of the mixed refrigerant is removed through line (47) and fed to an ethane recovery unit for further processing. Table 7 shows the operating parameters for this embodiment of the process. The composition of the feed gas, the sales gas stream and the $C_3$+ product stream, and the mixed refrigerant stream in mole fractions are provided in Table 8. Energy inputs for this embodiment included about $2.089\times10^6$ Btu/hr (Q) to the reboiler (30) and about 391 horsepower (P) to the ethane compressor (80).

TABLE 8

Mole Fractions of Components in Streams

| | Feed Gas (12) | Product (18) | Sales Gas (43) | Mixed Refrigerant (35) |
|---|---|---|---|---|
| Hydrogen | 0.3401 | 0.0000 | 0.6085 | 0.0034 |
| Methane | 0.2334 | 0.0000 | 0.3517 | 0.1520 |
| Ethane | 0.1887 | 0.0100 | 0.0392 | 0.6719 |
| Propane | 0.0924 | 0.2974 | 0.0006 | 0.1363 |
| Butane | 0.0769 | 0.3482 | 0.0000 | 0.0335 |
| Pentane | 0.0419 | 0.2087 | 0.0000 | 0.0028 |
| Heptane | 0.0267 | 0.1828 | 0.0000 | 0.0000 |
| $CO_2$ | 0.0000 | 0.1357 | 0.0000 | 0.0000 |
| Nitrogen | 0.0000 | 0.0000 | 0.0000 | 0.0000 |

As can be seen in Table 8, in this embodiment, the product stream (18) from the bottom of the distillation column is highly enriched in $C_3$+ components, while the sales gas stream (43) contains almost entirely $C_2$ and lighter hydrocarbons and gases. The mixed refrigerant is comprised primarily of $C_2$ and lighter components, but contains more propane than the sales gas.

Example 5

In this example, operating parameters are provided for the processing plant shown in FIG. 3 using a lean feed gas for recovery of $C_3$+ components in the product stream, with the $C_2$ and lighter components removed in the sales gas stream. In this embodiment, an absorber (120) is used to separate the distillation column overhead stream and the reflux separator overhead stream to obtain the mixed refrigerant. Table 9 shows the operating parameters for this embodiment of the process. The composition of the feed gas, the sales gas stream and the $C_3$+ product stream, and the mixed refrigerant stream in mole fractions are provided in Table 10. Energy inputs for this embodiment included about $3.734\times10^5$ Btu/hr (Q) to the reboiler (30) and about 316 horsepower (P) to the ethane compressor (80).

TABLE 10

Mole Fractions of Components in Streams

| | Feed Gas (12) | Product (18) | Sales Gas (43) | Mixed Refrigerant (35) |
|---|---|---|---|---|
| Methane | 0.9212 | 0.0000 | 0.9457 | 0.5987 |
| Ethane | 0.0396 | 0.0083 | 0.0397 | 0.3763 |
| Propane | 0.0105 | 0.4154 | 0.0001 | 0.0054 |
| Butane | 00036. | 0.1421 | 0.0000 | 0.0000 |
| Pentane | 0.0090 | 0.3552 | 0.0000 | 0.0000 |
| Heptane | 0.0020 | 0.0789 | 0.0000 | 0.0000 |
| $CO_2$ | 0.0050 | 0.0000 | 0.0051 | 0.0195 |
| Nitrogen | 0.0091 | 0.0000 | 0.0094 | 0.0001 |

As can be seen in Table 10, in this embodiment, the product stream (18) from the bottom of the distillation column is highly enriched in $C_3$+ components, while the sales gas stream (43) contains almost entirely $C_2$ and lighter hydrocarbons and gases. The mixed refrigerant is comprised primarily of $C_2$ and lighter components, but contains more propane than the sales gas.

Example 6

In this example, operating parameters are provided for the processing plant shown in FIG. 1 using a rich feed gas for the recovery of $C_3$+ components in the product stream, with the $C_2$ components removed in the sales gas stream. Table 11 shows the operating parameters for this embodiment of the process. The composition of the feed gas, the sales gas stream and the $C_3$+ product stream, and the mixed refrigerant stream in mole fractions are provided in Table 12. Energy inputs for this embodiment included about $1.458\times10^6$ Btu/hr (Q) to the reboiler (30) and about 226 horsepower (P) to the ethane compressor (80).

TABLE 12

Mole Fractions of Components in Streams

| | Feed Gas (12) | Product (18) | Sales Gas (43) | Mixed Refrigerant (35) |
|---|---|---|---|---|
| Methane | 0.7304 | 0.0000 | 0.8252 | 0.3071 |
| Ethane | 0.1429 | 0.0119 | 0.1566 | 0.6770 |
| Propane | 0.0681 | 0.5974 | 0.0003 | 0.0071 |
| Butane | 0.0257 | 0.2256 | 0.0000 | 0.0000 |
| Pentane | 0.0088 | 0.0772 | 0.0000 | 0.0000 |

TABLE 12-continued

Mole Fractions of Components in Streams

| | Feed Gas (12) | Product (18) | Sales Gas (43) | Mixed Refrigerant (35) |
|---|---|---|---|---|
| Heptane | 0.0100 | 0.0878 | 0.0000 | 0.0000 |
| $CO_2$ | 0.0050 | 0.0000 | 0.0056 | 0.0079 |
| Nitrogen | 0.0091 | 0.0000 | 0.0103 | 0.0009 |

As can be seen in Table 12, in this embodiment, the product stream (18) from the bottom of the distillation column is highly enriched in $C_3$+ components, while the sales gas stream (43) contains almost entirely $C_2$ and lighter hydrocarbons and gases. The mixed refrigerant is comprised primarily of $C_2$ and lighter components, but contains more propane than the sales gas.

While specific embodiments of the present invention have been described above, one skilled in the art will recognize that numerous variations or changes may be made to the process described above without departing from the scope of the invention as recited in the appended claims. Accordingly, the foregoing description of preferred embodiments is intended to describe the invention in an exemplary, rather than a limiting, sense.

TABLE 1

Material Streams

| | | 12 | 13 | 19 | 15 | 17 |
|---|---|---|---|---|---|---|
| Vapour Fraction | | 1.0000 | 0.9838 | 0.3989 | 0.0000 | 0.5000 |
| Temperature | F. | 120.0 | −25.00 | −129.0 | −30.00 | −29.68 |
| Pressure | psia | 415.0 | 410.0 | 400.0 | 21.88 | 20.88 |
| Molar Flow | MMSCFD | 10.00 | 10.00 | 11.76 | 1.317 | 1.317 |
| Mass Flow | lb/hr | 1.973e+004 | 1.973e+004 | 2.362e+004 | 6356 | 6356 |
| Liquid Volume Flow | barrel/day | 4203 | 4203 | 5100 | 862.2 | 862.2 |

| | | 14 | 18 | 32 | 34 | 42 |
|---|---|---|---|---|---|---|
| Vapour Fraction | | 1.0000 | 0.0000 | 0.6145 | 0.0000 | 1.0000 |
| Temperature | F. | −76.88 | 251.9 | −118.6 | −118.7 | −118.7 |
| Pressure | psia | 405.0 | 410.0 | 400.0 | 400.0 | 400.0 |
| Molar Flow | MMSCFD | 11.76 | 0.2517 | 15.89 | 6.139 | 9.723 |
| Mass Flow | lb/hr | 2.362e+004 | 1671 | 3.220e+004 | 1.414e+004 | 1.800e+004 |
| Liquid Volume Flow | barrel/day | 5100 | 196.3 | 6931 | 2925 | 3995 |

| | | 43 | 35 | 35a | 36 | 38 |
|---|---|---|---|---|---|---|
| Vapour Fraction | | 1.0000 | 0.2758 | 1.0000 | 1.0000 | 1.0000 |
| Temperature | F. | 110.0 | −165.0 | 90.00 | 262.2 | 120.0 |
| Pressure | psia | 395.0 | 149.9 | 144.9 | 470.0 | 465.0 |
| Molar Flow | MMSCFD | 9.723 | 6.139 | 6.139 | 6.139 | 6.139 |
| Mass Flow | lb/hr | 1.800e+004 | 1.414e+004 | 1.414e+004 | 1.414e+004 | 1.414e+004 |
| Liquid Volume Flow | barrel/day | 3995 | 2925 | 2925 | 2925 | 2925 |

| | | 39 | 28 | 26 | 26a | 28a |
|---|---|---|---|---|---|---|
| Vapour Fraction | | 0.6723 | 1.0000 | 0.0000 | 0.0452 | .09925 |
| Temperature | F. | −63.00 | −63.00 | −63.00 | −68.04 | −69.27 |
| Pressure | psia | 460.0 | 460.0 | 460.0 | 415.0 | 400.0 |
| Molar Flow | MMSCFD | 6.139 | 4.127 | 2.011 | 2.011 | 4.127 |
| Mass Flow | lb/hr | 1.414e+004 | 8573 | 5566 | 5566 | 8573 |
| Liquid Volume Flow | barrel/day | 2925 | 1831 | 1094 | 1094 | 1831 |

TABLE 3

Material Streams

| | | 12 | 13 | 19 | 15 | 17 |
|---|---|---|---|---|---|---|
| Vapour Fraction | | 0.9617 | 0.7601 | 0.7649 | 0.0000 | 0.5000 |
| Temperature | F. | 120.0 | −5.00 | −85.00 | −15.00 | −14.37 |
| Pressure | psia | 200.0 | 195.0 | 185.0 | 30.12 | 29.12 |
| Molar Flow | MMSCFD | 10.00 | 10.00 | 9.821 | 8.498 | 8.498 |
| Mass Flow | lb/hr | 2.673e+004 | 2.673e+004 | 1.852e+004 | 4.102e+004 | 4.102e+004 |
| Liquid Volume Flow | barrel/day | 4723 | 4723 | 4252 | 5564 | 5564 |

| | | 14 | 18 | 32 | 34 | 42 |
|---|---|---|---|---|---|---|
| Vapour Fraction | | 1.0000 | 0.0000 | 0.7669 | 0.0000 | 1.0000 |
| Temperature | F. | −50.25 | 162.6 | −84.09 | −84.07 | −84.07 |
| Pressure | psia | 190.0 | 195.0 | 185.0 | 185.0 | 185.0 |
| Molar Flow | MMSCFD | 9.821 | 2.377 | 9.937 | 2.314 | 7.617 |
| Mass Flow | lb/hr | 1.852e+004 | 1.559e+004 | 1.883e+004 | 7696 | 1.112e+004 |
| Liquid Volume Flow | barrel/day | 4252 | 1844 | 4314 | 1436 | 2876 |

| | | 43 | 35 | 35a | 36 | 38 | 39 | 28 | 26 | 26a | 28a |
|---|---|---|---|---|---|---|---|---|---|---|---|
| Vapour Fraction | | 1.0000 | 0.0833 | 1.0000 | 1.0000 | 1.0000 | 0.0500 | 1.0000 | 0.0000 | 0.0032 | 1.0000 |
| Temperature | F. | 110.0 | −103.0 | 90.00 | 260.4 | 120.0 | −29.77 | −29.77 | −29.77 | −30.32 | −33.30 |
| Pressure | psia | 180.0 | 50.8 | 45.8 | 215.0 | 210.0 | 205.0 | 205.0 | 205.0 | 200.0 | 185.0 |
| Molar Flow | MMSCFD | 7.617 | 2.314 | 2.314 | 2.314 | 2.314 | 2.314 | 0.1157 | 2.198 | 2.198 | 0.1157 |
| Mass Flow | lb/hr | 1.112e+004 | 7696 | 7696 | 7696 | 7696 | 7696 | 308.1 | 7388 | 7388 | 308.1 |
| Liquid Volume Flow | barrel/day | 2876 | 1436 | 1436 | 1436 | 1436 | 1436 | 62.34 | 1373 | 1373 | 62.34 |

TABLE 5

Material Streams

| | | 12 | 13 | 19 | 15 | 17 |
|---|---|---|---|---|---|---|
| Vapour Fraction | | 0.9805 | 0.8125 | 0.8225 | 0.0000 | 0.5000 |
| Temperature | F. | 120.0 | 0.00 | −43.00 | −20.00 | −19.46 |
| Pressure | psia | 135.0 | 130.0 | 120.0 | 27.15 | 26.15 |
| Molar Flow | MMSCFD | 10.00 | 10.00 | 10.31 | 8.058 | 8.058 |
| Mass Flow | lb/hr | 2.673e+004 | 2.673e+004 | 2.339e+004 | 3.890e+004 | 3.890e+004 |
| Liquid Volume Flow | barrel/day | 4723 | 4723 | 4624 | 5276 | 5276 |

| | | 14 | 18 | 32 | 34 | 42 |
|---|---|---|---|---|---|---|
| Vapour Fraction | | 1.0000 | 0.0000 | 0.8234 | 0.0000 | 1.0000 |
| Temperature | F. | −13.13 | 195.3 | −42.52 | −42.49 | −42.49 |
| Pressure | psia | 125.0 | 130.0 | 120.0 | 120.0 | 120.0 |
| Molar Flow | MMSCFD | 10.31 | 1.462 | 10.38 | 1.840 | 8.557 |
| Mass Flow | lb/hr | 2.339e+004 | 1.119e+004 | 2.360e+004 | 8068 | 1.561e+004 |
| Liquid Volume Flow | barrel/day | 4624 | 1245 | 4661 | 1183 | 3490 |

| | | 43 | 35 | 35a | 36 | 38 | 39 | 28 | 26 | 26a | 28a |
|---|---|---|---|---|---|---|---|---|---|---|---|
| Vapour Fraction | | 1.0000 | 0.0805 | 1.0000 | 1.0000 | 1.0000 | 0.0349 | 1.0000 | 0.0000 | 0.0038 | 1.0000 |
| Temperature | F. | 110.0 | −62.0 | 90.00 | 238.2 | 120.0 | 15.00 | 15.00 | 15.00 | 14.31 | 11.44 |
| Pressure | psia | 115.0 | 31.75 | 26.75 | 150.0 | 145.0 | 140.0 | 140.0 | 140.0 | 135.0 | 120.0 |
| Molar Flow | MMSCFD | 8.557 | 1.840 | 1.840 | 1.840 | 1.840 | 1.840 | 6.425e−002 | 1.776 | 1.776 | 6.425e−002 |
| Mass Flow | lb/hr | 1.561e+004 | 8068 | 8068 | 8068 | 8068 | 8068 | 211.4 | 7856 | 7856 | 211.4 |
| Liquid Volume Flow | barrel/day | 3490 | 1183 | 1183 | 1183 | 1183 | 1183 | 36.58 | 1147 | 1147 | 36.58 |

TABLE 7

| Material Streams | | 12 | 13 | 19 | 15 | 17 | 14 |
|---|---|---|---|---|---|---|---|
| Vapour Fraction | | 0.9617 | 0.7202 | 0.6831 | 0.0000 | 0.5000 | 1.0000 |
| Temperature | F. | 120.0 | −25.00 | −145.0 | −30.00 | −29.68 | −22.80 |
| Pressure | psia | 200.0 | 195.0 | 185.0 | 21.88 | 20.88 | 190.0 |
| Molar Flow | MMSCFD | 10.00 | 10.00 | 8.153 | 7.268 | 7.628 | 8.153 |
| Mass Flow | lb/hr | 2.673e+004 | 2.673e+004 | 1.367e+004 | 3.508e+004 | 3.508e+004 | 1.367e+004 |
| Liquid Volume Flow | barrel/day | 4723 | 4723 | 3231 | 4758 | 4758 | 3231 |

| | | 18 | 32 | 34 | 42 | 43 |
|---|---|---|---|---|---|---|
| Vapour Fraction | | 0.0000 | 0.6833 | 0.0000 | 1.0000 | 1.000 |
| Temperature | F. | 176.0 | −144.9 | −144.9 | −144.9 | 110.0 |
| Pressure | psia | 195.0 | 185.0 | 185.0 | 185.0 | 180.0 |
| Molar Flow | MMSCFD | 1.970 | 8.160 | 2.589 | 5.576 | 5.576 |
| Mass Flow | lb/hr | 1.348e+004 | 1.369e+004 | 8758 | 4943 | 4943 |
| Liquid Volume Flow | barrel/day | 1567 | 3234 | 1570 | 1667 | 1667 |

| | | 35 | 35a | 36 | 38 | 39 | 28 | 26 |
|---|---|---|---|---|---|---|---|---|
| Vapour Fraction | | 0.0957 | 1.0000 | 1.0000 | 1.0000 | 0.0500 | 1.0000 | 0.0000 |
| Temperature | F. | −163.1 | 90.00 | 330.0 | 120.0 | −61.75 | −61.75 | −61.75 |
| Pressure | psia | 28.00 | 23.00 | 215.0 | 210.0 | 205.0 | 205.0 | 205.0 |
| Molar Flow | MMSCFD | 2.589 | 2.589 | 2.589 | 2.589 | 0.1294 | 6.472e−003 | 0.1230 |
| Mass Flow | lb/hr | 8758 | 8758 | 8758 | 8758 | 437.9 | 14.05 | 423.8 |
| Liquid Volume Flow | barrel/day | 1570 | 1570 | 1570 | 1570 | 78.48 | 3.009 | 75.47 |

| | | 26a | 28a | 45 | 47 |
|---|---|---|---|---|---|
| Vapour Fraction | | 0.0028 | 1.0000 | 1.000 | 1.0000 |
| Temperature | F. | −62.15 | −64.65 | 120.0 | 120.0 |
| Pressure | psia | 200.0 | 185.0 | 210.0 | 210.0 |
| Molar Flow | MMSCFD | 0.1230 | 6.472e−003 | 0.1294 | 2.459 |
| Mass Flow | lb/hr | 423.8 | 14.05 | 437.9 | 8320 |
| Liquid Volume Flow | barrel/day | 75.47 | 3.009 | 78.48 | 1491 |

TABLE 9

| Material Streams | | 12 | 13 | 19 | 15 | 17 | 14 | 18 | 32 | 34 | 42 |
|---|---|---|---|---|---|---|---|---|---|---|---|
| Vapour Fraction | | 1.0000 | 0.9838 | 0.6646 | 0.0000 | 0.5000 | 1.0000 | 0.0000 | 0.9925 | 0.0000 | 1.0000 |
| Temperature | F. | 120.0 | −25.00 | −119.0 | −30.00 | −29.68 | −79.00 | 251.1 | −77.01 | −109.5 | −118.9 |
| Pressure | psia | 415.0 | 410.0 | 400.0 | 21.88 | 20.88 | 405.0 | 410.0 | 405.0 | 405.0 | 400.0 |
| Molar Flow | MMSCFD | 10.00 | 10.00 | 11.83 | 1.263 | 1.263 | 11.83 | 0.2534 | 1.577 | 3.668 | 9.730 |
| Mass Flow | lb/hr | 1.973e+004 | 1.973e+004 | 2.369e+004 | 6096 | 6096 | 2.369e+004 | 1679 | 3206 | 8867 | 1.801e+004 |
| Liquid Volume Flow | barrel/day | 4203 | 4203 | 5115 | 826.9 | 826.9 | 5115 | 197.4 | 688.7 | 1804 | 3997 |

| | | 35 | 35a | 36 | 38 | 39 | 28 | 26 | 26a | 43 |
|---|---|---|---|---|---|---|---|---|---|---|
| Vapour Fraction | | 0.3049 | 1.0000 | 1.0000 | 1.0000 | 0.4300 | 1.0000 | 0.0000 | 0.0464 | 1.000 |
| Temperature | F. | −162.0 | 90.00 | 280.9 | 120.0 | −71.34 | −71.34 | −71.34 | −76.54 | 110.0 |
| Pressure | psia | 128.30 | 123.30 | 470.0 | 465.0 | 460.0 | 460.0 | 460.0 | 415.0 | 395.0 |
| Molar Flow | MMSCFD | 3.668 | 3.668 | 3.668 | 3.668 | 3.688 | 1.577 | 2.091 | 2.091 | 9.730 |
| Mass Flow | lb/hr | 8867 | 8867 | 8867 | 8867 | 8867 | 3206 | 5661 | 5661 | 1.801e+004 |
| Liquid Volume Flow | barrel/day | 1804 | 1804 | 1804 | 1804 | 1804 | 688.7 | 1115 | 1115 | 3997 |

TABLE 11

Material Streams

| | | 12 | 13 | 19 | 15 | 17 |
|---|---|---|---|---|---|---|
| Vapour Fraction | | 1.0000 | 0.8833 | 0.7394 | 0.0000 | 0.5000 |
| Temperature | F. | 120.0 | −20.00 | −85.5 | −30.00 | −29.68 |
| Pressure | psia | 315.0 | 310.0 | 305.0 | 21.88 | 20.88 |
| Molar Flow | MMSCFD | 10.00 | 10.00 | 11.37 | 5.018 | 5.018 |
| Mass Flow | lb/hr | 2.484e+004 | 2.484e+004 | 2.549e+004 | 2.422e+004 | 2.422e+004 |
| Liquid Volume Flow | barrel/day | 4721 | 4721 | 5338 | 3285 | 3285 |

| | | 14 | 18 | 32 | 34 | 42 |
|---|---|---|---|---|---|---|
| Vapour Fraction | | 1.0000 | 0.0000 | 0.7491 | 0.0000 | 1.0000 |
| Temperature | F. | −55.13 | 181.7 | −84.23 | −84.24 | −84.24 |
| Pressure | psia | 310.0 | 315.0 | 305.0 | 305.0 | 305.0 |
| Molar Flow | MMSCFD | 11.37 | 1.139 | 11.81 | 2.952 | 8.844 |
| Mass Flow | lb/hr | 2.549e+004 | 6778 | 2.648e+004 | 8419 | 1.802e+004 |
| Liquid Volume Flow | barrel/day | 5338 | 834.5 | 5546 | 1660 | 3877 |

| | | 43 | 35 | 35a | 36 | 38 | 39 | 28 | 26 | 26a | 28a |
|---|---|---|---|---|---|---|---|---|---|---|---|
| Vapour Fraction | | 1.0000 | 0.2044 | 1.0000 | 1.0000 | 1.0000 | 0.1500 | 1.0000 | 0.0000 | 0.0434 | .09975 |
| Temperature | F. | 110.0 | −120.0 | 90.00 | 246.2 | 120.0 | −49.05 | −49.05 | −49.05 | −54.73 | −57.22 |
| Pressure | psia | 300.0 | 113.9 | 108.9 | 375.0 | 370.0 | 365.0 | 365.0 | 365.0 | 320.0 | 305.0 |
| Molar Flow | MMSCFD | 8.844 | 2.952 | 2952 | 2952 | 2952 | 2952 | 0.4429 | 2.510 | 2.510 | 0.4429 |
| Mass Flow | lb/hr | 1.802e+004 | 8419 | 8419 | 8419 | 8419 | 8419 | 990.7 | 7429 | 7429 | 990.7 |
| Liquid Volume Flow | barrel/day | 3877 | 1660 | 1660 | 1660 | 1660 | 1660 | 207.9 | 1452 | 1452 | 207.9 |

The invention claimed is:

1. A process for recovery of natural gas liquids from a feed gas stream, comprising the steps of:

(a) supplying a feed gas stream and cooling the feed gas stream in a heat exchanger;

(b) feeding the cooled feed gas stream to a distillation column wherein lighter components of the feed gas stream are removed from the distillation column as an overhead vapor stream and heavier components of the feed gas stream are removed from the distillation column in the bottoms as a product stream;

(c) feeding the distillation column overhead stream to the heat exchanger and cooling the stream to at least partially liquefy the overhead stream;

(d) feeding the partially liquefied distillation overhead stream to a first separator;

(e) separating the vapors and liquids in the first separator to produce an overhead vapor stream comprising sales gas and a bottoms stream comprising a mixed refrigerant;

(f) feeding the mixed refrigerant stream to the heat exchanger to provide cooling, wherein the mixed refrigerant stream vaporizes as it the mixed refrigerant stream passes through the heat exchanger;

(g) compressing at least a portion of the vaporized mixed refrigerant stream and passing the compressed mixed refrigerant stream through the heat exchanger;

(h) feeding the compressed mixed refrigerant stream to a second separator; and (i) feeding the bottoms from the second separator to the distillation column as a reflux stream and feeding the overhead from the second separator to the first separator.

2. The process of claim 1, further comprising the step of reducing the temperature of the mixed refrigerant stream before it the mixed refrigerant stream enters the heat exchanger by reducing the pressure of the mixed refrigerant using a control valve.

3. The process of claim 1, further comprising the step of combining the overhead stream from the second separator with the overhead stream from the distillation column and feeding the combined stream to the first separator.

4. The process of claim 1, further comprising the step of cooling the compressed mixed refrigerant in a cooler before passing the compressed mixed refrigerant stream through the heat exchanger.

5. The process of claim 1, wherein the first separator is an absorber.

6. The process of claim 1, wherein the feed gas stream is one of natural gas or refinery gas.

7. The process of claim 1, wherein the product stream comprises at least about 99% by weight $C_3$+ hydrocarbons.

8. The process of claim 1, wherein the product stream comprises at least about 97% of the $C_3$+ hydrocarbons in the feed gas.

9. The process of claim 1, wherein the product stream comprises at least about 55% of the $C_2$+ hydrocarbons in the feed gas.

10. The process of claim 1, wherein the product stream comprises at least about 99% of the $C_4$+ hydrocarbons in the feed gas.

11. The process of claim 1, wherein the distillation column operates at a pressure of between about 100 psia and 450 psia.

12. A process for recovery of natural gas liquids from a feed gas stream, comprising the steps of:

(a) supplying a feed gas stream and cooling the feed gas stream in a heat exchanger;

(b) feeding the cooled feed gas stream to a distillation column wherein lighter components of the feed gas stream are removed from the distillation column as an overhead vapor stream and heavier components of the feed gas stream are removed from the distillation column in the bottoms as a product stream;

(c) feeding the distillation column overhead stream to the heat exchanger and cooling the stream to at least partially liquefy the overhead stream;

(d) feeding the partially liquefied distillation overhead stream to a separator;

(e) separating the vapors and liquids in the separator to produce an overhead vapor stream comprising sales gas and a bottoms stream comprising a mixed refrigerant;

(f) feeding the mixed refrigerant stream to the heat exchanger to provide cooling, wherein the mixed refrigerant stream vaporizes as the mixed refrigerant stream passes through the heat exchanger;

(g) compressing the vaporized mixed refrigerant stream and passing the compressed mixed refrigerant stream through the heat exchanger; and (h) feeding the compressed mixed refrigerant stream to the distillation column as a reflux stream.

13. An apparatus for separating natural gas liquids from a feed gas stream, the apparatus comprising:

(a) a heat exchanger operable to provide the heating and cooling necessary for separation of natural gas liquids from a feed gas stream by heat exchange contact between the feed gas stream and one or more process streams;

(b) a distillation column for receiving the feed gas stream and separating the feed gas stream into a column overhead stream comprising a substantial amount of the lighter hydrocarbon components of the feed gas stream and a column bottoms stream comprising a substantial amount of the heavier hydrocarbon components;

(c) a first separator for receiving the distillation column overhead stream and separating the column overhead stream into an overhead sales gas stream and a bottoms stream comprising a mixed refrigerant for providing process cooling in the heat exchanger;

(d) a compressor for compressing the mixed refrigerant stream after the mixed refrigerant stream has provided process cooling in the heat exchanger;

(e) a second separator for receiving the compressed mixed refrigerant stream and separating the compressed mixed refrigerant into an overhead stream and a bottoms stream that is fed to the distillation column as a reflux stream.

14. The apparatus of claim 13, wherein the first separator is an absorber.

* * * * *

UNITED STATES PATENT AND TRADEMARK OFFICE

CERTIFICATE OF CORRECTION

PATENT NO. : 8,209,997 B2
APPLICATION NO. : 12/121880
DATED : July 3, 2012
INVENTOR(S) : Michael Malsam It is certified that error appears in the above-identified patent and that said Letters Patent is hereby corrected as shown below:

Column 17, line 53, delete "it".

Column 17, line 65, delete "it".

Signed and Sealed this
Nineteenth Day of February, 2013

Teresa Stanek Rea
*Acting Director of the United States Patent and Trademark Office*